US005938458A

United States Patent [19]

Krehbiel et al.

[11] Patent Number: 5,938,458

[45] Date of Patent: Aug. 17, 1999

[54] LEVER TYPE ELECTRICAL CONNECTOR

[75] Inventors: Fred Love Krehbiel, Chicago; Paul Christopher Berg, Batavia; Duane M. Fencl, Countryside, all of Ill.

[73] Assignee: Molex Incorporated, Lisle, Ill.

[21] Appl. No.: 09/098,861

[22] Filed: Jun. 17, 1998

[51] Int. Cl.[6] ..... H01R 13/62

[52] U.S. Cl. ..... 439/157

[58] Field of Search ..... 439/157, 372

[56] References Cited

U.S. PATENT DOCUMENTS

| | | | |
|---|---|---|---|
| 5,135,410 | 8/1992 | Kawase et al. | 439/372 |
| 5,308,254 | 5/1994 | Hatagishi et al. | 439/157 |
| 5,328,377 | 7/1994 | Saito | 439/157 |
| 5,330,411 | 7/1994 | Fujitani et al. | 439/157 |
| 5,401,179 | 3/1995 | Shinchi et al. | 439/157 |
| 5,441,420 | 8/1995 | Okumura et al. | 439/157 |
| 5,443,393 | 8/1995 | Okumura et al. | 439/157 |
| 5,445,530 | 8/1995 | Inoue et al. | 439/157 |
| 5,453,018 | 9/1995 | Ito et al. | 439/157 |
| 5,460,534 | 10/1995 | Taniuchi et al. | 439/157 |
| 5,681,175 | 10/1997 | Busse et al. | 439/157 |

FOREIGN PATENT DOCUMENTS

0608114 B1 7/1994 European Pat. Off. ..... H01R 13/629

*Primary Examiner*—Steven L. Stephan
*Assistant Examiner*—Javaid Nasri
*Attorney, Agent, or Firm*—Stacey E. Caldwell

[57] ABSTRACT

A lever type electrical connector assembly includes a first connector having an actuating lever pivotally mounted thereon. The actuating lever includes a cam groove formed therein. A second connector has a cam follower projection to be engaged in the cam groove of the actuating lever. The connectors are mated and unmated in response to rotation of the actuating lever. Complementary interengaging pivot bosses and pivot journals are provided between the actuating lever and the first connector. Separate and independently interengaging pivot bosses and pivot journals are provided on both the inside and the outside of the actuating lever.

18 Claims, 5 Drawing Sheets

LEVER TYPE ELECTRICAL CONNECTOR

FIELD OF THE INVENTION

This invention generally relates to the art of electrical connectors and, particularly, to an electrical connector having a lever whereby mating and unmating of the connector with a second connector is effected by rotation of the lever.

BACKGROUND OF THE INVENTION

A typical lever type electrical connector assembly includes a first connector which has an actuating lever rotatably mounted thereon for connecting and disconnecting the connector with a complementary mating second connector. The actuating lever and the second connector typically have a cam groove/cam follower arrangement for drawing the second connector into mating condition with the first connector in response to rotation of the lever. Such lever type connectors often are used where large forces are required to mate and unmate a pair of connectors. For instance, terminal and housing frictional forces encountered during connecting and disconnecting the connectors may make the process difficult to perform by hand.

A common structure for a lever type electrical connector of the character described above is to provide a generally U-shaped lever structure having a pair of lever arms which are disposed on opposite sides of the first ("actuator") connector. The lever arms may have cam grooves for engaging cam follower projections or posts on opposite sides of the second ("mating") connector. One of the problems with such structural combinations is that the lever arms have a tendency to spread apart under high mating force loads encountered during mating of the connectors when rotational forces are applied to the lever structure. Another problem involves the cam follower projections or posts on the mating connector, which have a tendency to break when the connector housings are molded of plastic material. Still another problem involves the mating connector "cocking" when drawn by the lever structure into mating position with the actuator connector. A further problem involves the inability of holding the mating connector in a pre-mating position while manipulative efforts must be used to rotate the lever to draw the mating connector into full mated position with the actuator connector. The present invention is directed to solving this myriad of problems which continue to be detrimental to the use of lever type electrical connectors.

SUMMARY OF THE INVENTION

An object, therefore, of the invention is to provide a new and improved lever type electrical connector assembly.

In the exemplary embodiment of the invention, a first connector pivotally mounts an actuating lever which includes a cam groove formed therein. A second connector has a cam follower projection for engagement in the cam groove of the actuating lever. The connectors thereby are mated and unmated in response to rotation of the lever. Complementary interengaging pivot means are provided between the actuating lever and the first connector. The pivot means include separate, independently interengaging pivots between the lever and the first connector on both an inside and an outside of the actuating lever. This prevents the lever from moving laterally when forces are applied thereto during rotation thereof.

As disclosed herein, the actuating lever includes a pair of pivot bosses on opposite sides thereof engageable in a pair of pivot journals on the first connector on opposite sides of the lever. The first connector includes a housing and a support wall spaced outwardly of the housing, with the actuating lever disposed therebetween. The pivot journals are formed by holes in the housing and in the support wall for receiving the pivot bosses projecting from opposite sides of the actuating lever. In the preferred embodiment, the actuating lever comprises one actuating arm of a generally U-shaped lever structure having a pair of actuating arms pivotally mounted on opposite sides of the first connector.

Another feature of the invention is that the first connector includes ramps for facilitating assembly of the pivot bosses of the actuating lever into the pivot journals of the first connector. Other features include the provision of an integrally molded support rib leading from and integral with the cam follower projection to prevent breakage of the projection. The support rib extends in the mating direction of the connectors, and still a further feature involves the provision of a groove on the first connector for receiving the support rib and preventing cocking of the connectors during mating.

Finally, another feature of the invention is that the cam groove in the actuating lever includes a mouth with a detent that captures the cam follower projection prior to rotation of the lever. This provides a pre-mated position of the second connector in engagement with the first connector, prior to an operator rotating the lever to fully mate the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
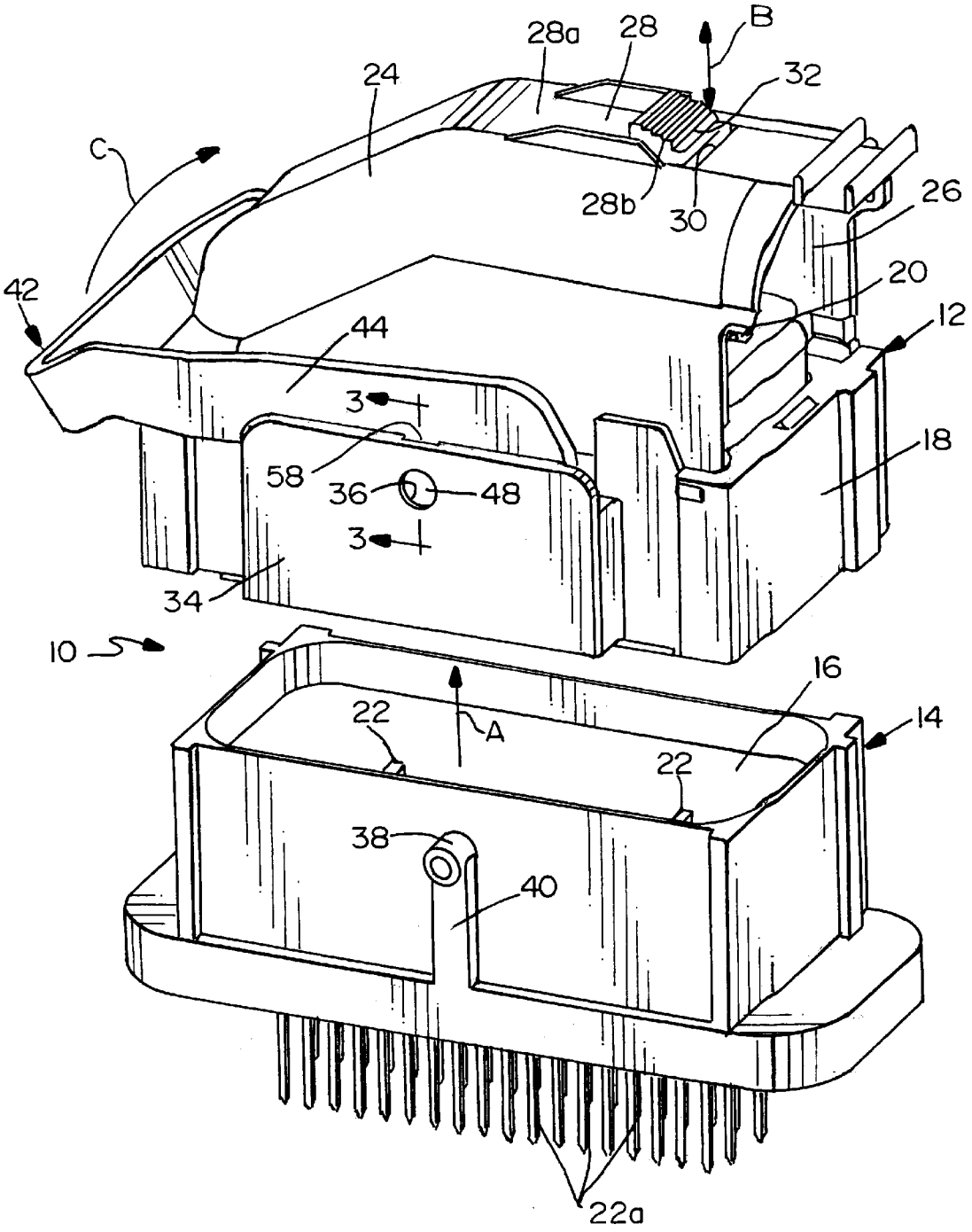
FIG. 1 is a perspective view of the pair of connectors prior to any engagement.

Referring to the drawings in greater detail, and first to FIG. 1, the invention is embodied in a lever type electrical connector assembly, generally designated 10. The assembly includes a first ("actuator") connector, generally designated 12, and a second ("mating") connector, generally designated 14. The mating connector includes a molded plastic housing 16 which is inserted into a molded plastic housing 18 of the actuator connector when the connectors are mated in the direction of arrow "A". The actuator connector mounts a plurality of terminals 20 which make contact with a plurality of terminals 22 mounted on the mating connector. Terminals 22 of the mating connector have tail portions 22*a* for insertion into holes in an appropriate printed circuit board (not shown) and for connection to circuit traces on the board and/or in the holes. The terminals could also be used in wire applications wherein the tail portions are crimped onto wires. Further details of actuator connector 12 and mating connector 14 and their respective terminal arrangements will not be described herein, because the invention is applicable for a wide variety or range of electrical connector configurations.

Still referring to FIG. 1, actuator connector 12 includes a shroud 24 which substantially covers the top thereof and provides an opening 26 for ingress/egress of an electrical cable having conductors terminated to terminals 20. A flexible latch arm 28 is integral with the shroud at a proximal end 28*a* thereof, and a distal end 28*b* of the latch arm is movable within a cutout 30 in the direction of double-headed arrow "B". The distal end of the latch arm has a raised portion to define a latch shoulder 32. Shroud 24 may be a separate component, such as of molded plastic material, appropriately assembled to the top of housing 18 of the actuator connector. The housing has a support wall 34 on each opposite side thereof spaced outwardly from the housing.

Each support wall includes a pivot journal in the form of a hole 36.

As best seen in FIG. 1, housing 16 of mating connector 14 has a cam follower projection or post 38 that projects outwardly from each opposite side thereof. A support rib 40 leads from and is integral with each cam follower post 38. It can be seen that the support rib extends in the mating direction of the connectors as indicated by arrow "A". Housing 16, cam follower post 38 and support rib 40 all are unitarily molded of plastic material. The rib provides support for the post to prevent breakage of the post. The rib also prevents cocking of the connectors during mating, as will be described in greater detail hereinafter.

Figure 2:
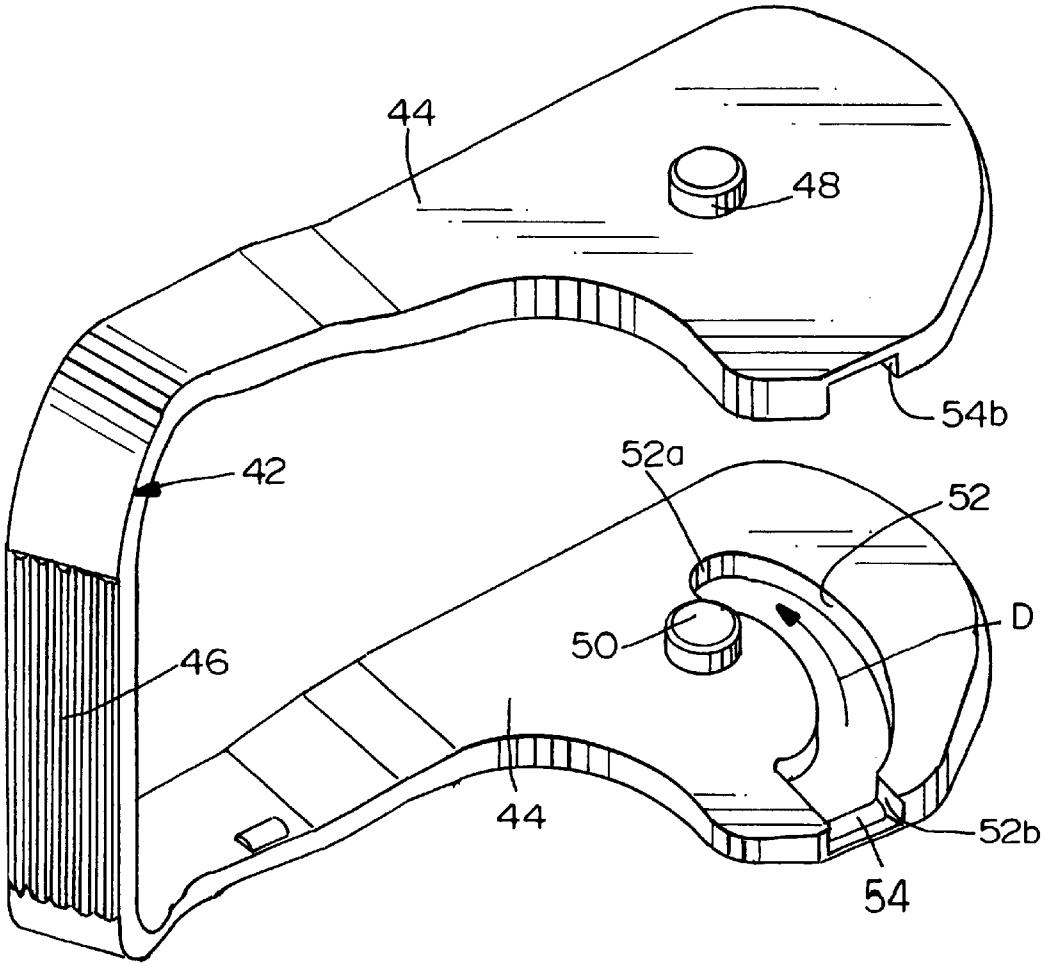
FIG. 2 is a perspective view of the U-shaped lever.

Referring to FIG. 2 in conjunction with FIG. 1, a generally U-shaped lever structure, generally designated 42, is pivotally mounted on housing 18 of actuator connector 12. The lever structure is rotatable upwardly in the direction of arrow "C" to draw mating connector 14 into mated condition with the actuator connector. The U-shaped lever structure defines a pair of actuating arms 44 joined by a cross portion 46 which spans the width of the actuator connector. Each actuating arm has a pivot boss 48 on the outside thereof and a pivot boss 50 on the inside thereof. The inside of each arm has a cam groove 52 which extends from a closed end 52*a* to an open mouth 52*b*. A detent rib 54 extends across the open mouth. As clearly seen in FIG. 2, open mouth 52*b* is at a greater radius from pivot bosses 48/50 than closed end 52*a*. Therefore, when cam follower posts 38 (FIG. 1) move within cam grooves 52 in the direction of arrow "D" (FIG. 2), in response to rotation of the lever structure, the mating connector will be drawn into mated condition with the actuator connector as will be described hereinafter.

Figure 3:
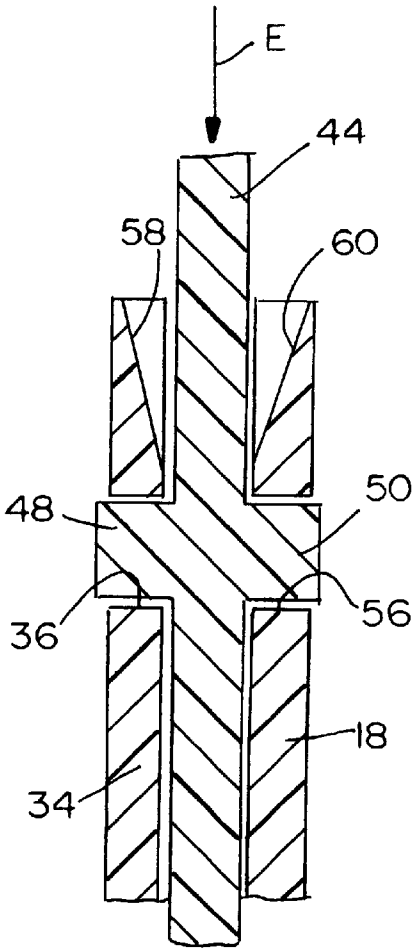
FIG. 3 is a fragmented, vertical section, on an enlarged scale, taken generally along line 3—3 of FIG. 1.

FIG. 3 shows one of the actuating arms 44 of lever structure 42 sandwiched between one of the support walls 34 which is spaced outwardly from housing 18 of the actuator connector. It can be seen that the outside pivot boss 48 of the actuating arm projects into pivot hole 36 of the support wall. Inside pivot boss 50 of the actuating arm extends into a pivot hole 56 in an inside wall of the connector housing. Therefore, separate and independently interengaging pivots are provided between the actuating arm of the lever and the actuator connector on both the inside and the outside of the actuating arm. This prevents the two actuating arms of the U-shaped lever structure from spreading apart or moving outwardly of the connector housing during actuation and when encountering significant mating forces.

FIG. 3 shows a feature of the invention wherein angled grooves or ramps 58 and 60 are provided on the inside of each support wall 34 and the outside of the connector housing, respectively. Ramps 58 and 60 lead to pivot journals or holes 36 and 56, respectively. The ramps facilitate assembly of lever structure 42 onto housing 18 of actuator 12. In other words, actuating arms 44 are assembled in the direction of arrow "E" (FIG. 3). The distal ends of pivot bosses 48 and 50 ride down ramps 58 and 60, respectively, spreading support wall 34 outwardly, until the pivot bosses snap into pivot holes 36 and 56. Ramp 58 in one of the support walls 34 can be seen in FIG. 1, and one of the ramps 60 on the actuator connector housing can be seen in FIG. 6.

Figure 4:
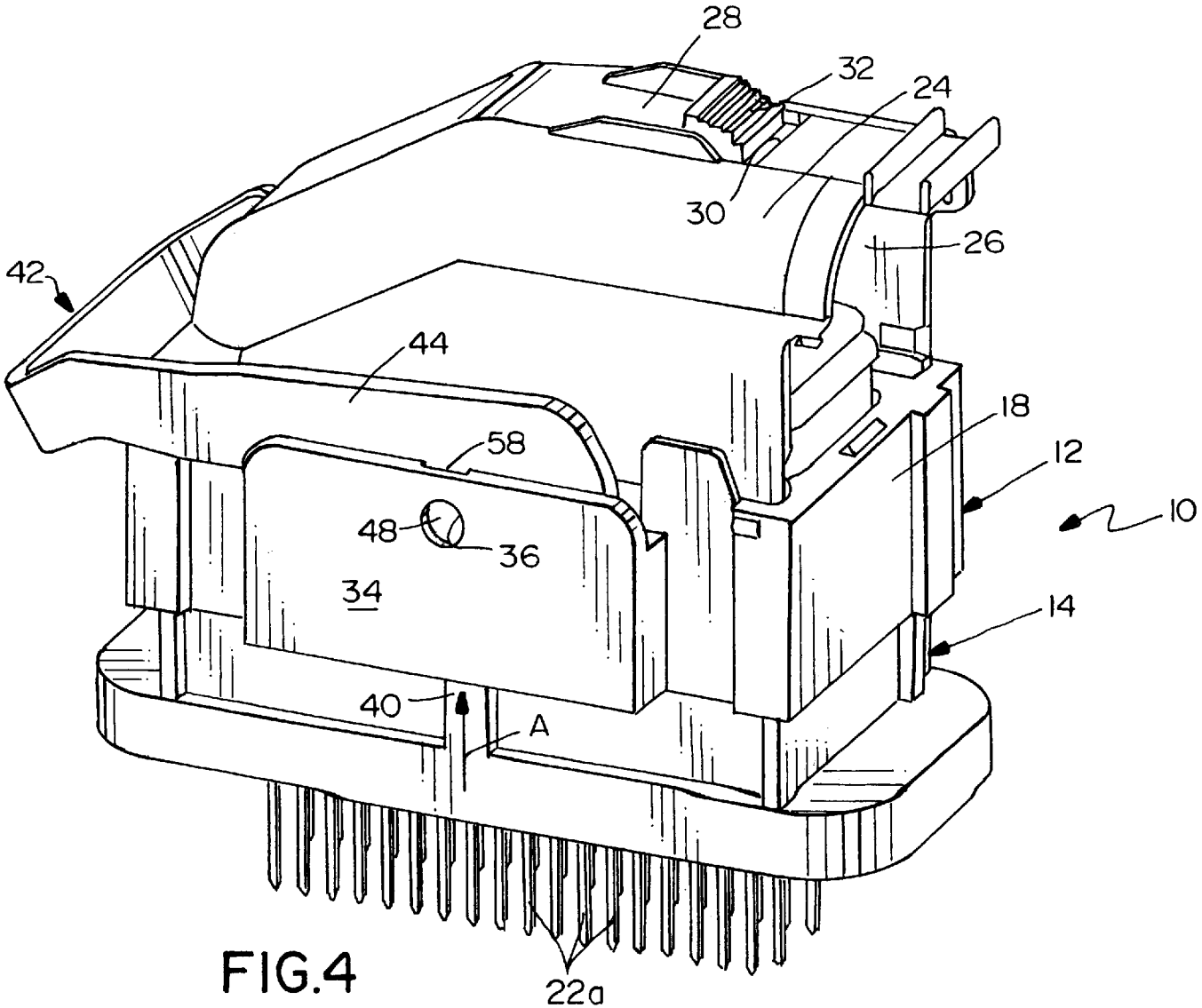
FIG. 4 is a perspective view of the two connectors in pre-mated condition.

FIG. 4 shows a pre-mated position of mating connector 14 with actuator connector 12, and with lever structure 42 still in its inoperative position. When in the inoperative position of the lever structure, open mouths 52*b* (FIG. 2) of cam grooves 52 on the insides of actuating arms 44 face downwardly for receiving cam follower posts 38 of the mating connector. When mating connector 14 is moved in the direction of arrows "A" (FIGS. 1 and 4), cam follower posts 38 snap behind detent ribs 54 (FIG. 2) which span the open mouths to the cam grooves. These detent ribs are effective to hold mating connector 14 in a pre-mated position with actuator connector 12 as seen in FIG. 4, so that an operator can easily manipulate and rotate lever structure 42 without concern that the mating connector will become disengaged from the actuator connector.

Figure 5:
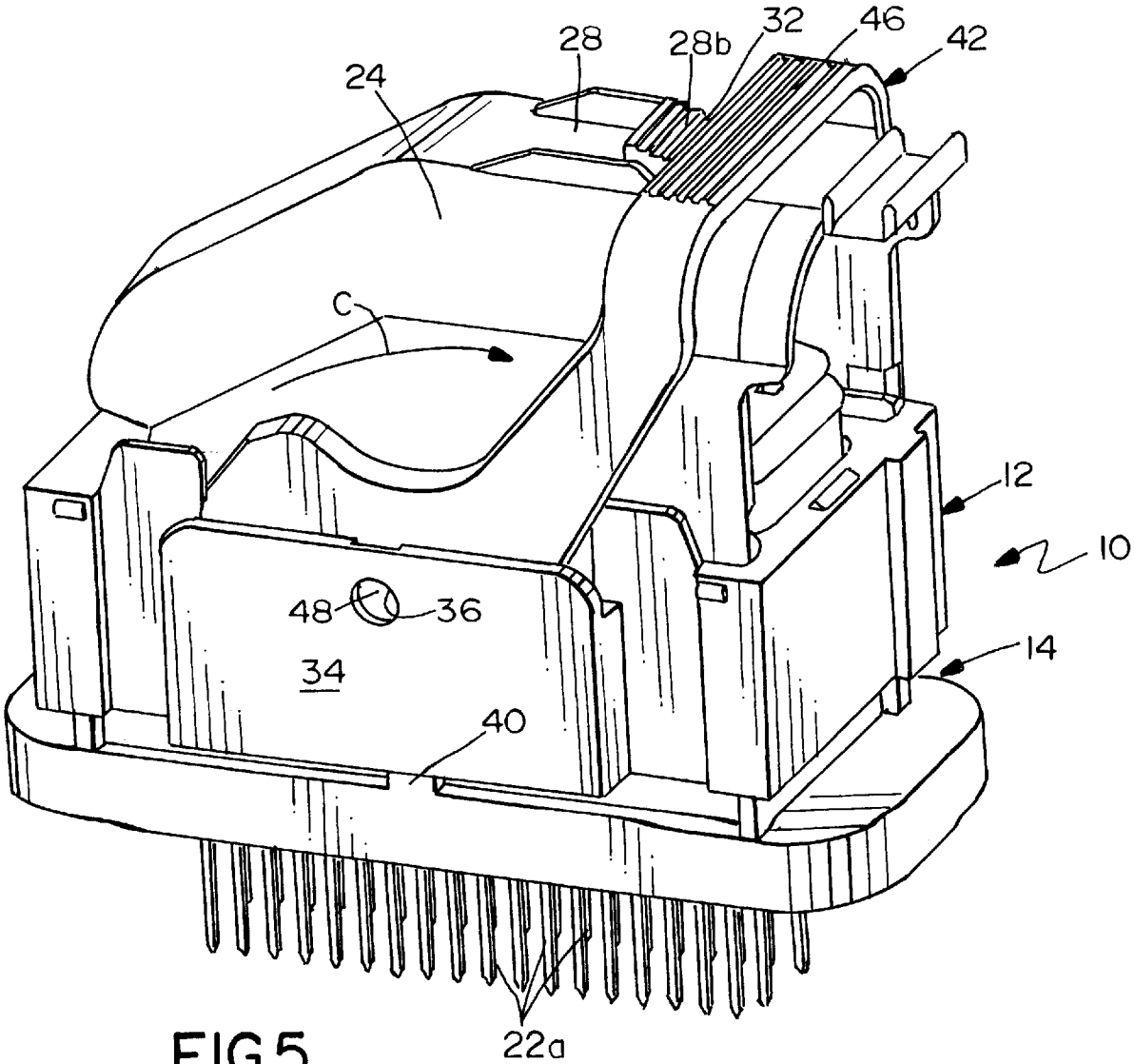
FIG. 5 is a perspective view of the two connectors fully mated.

FIG. 5 shows lever structure 42 having been pivoted in the direction of arrow "C" to its fully operative position whereby cam grooves 52 (FIG. 2) have drawn mating connector 14 into full mated position with actuator connector 12, as cam follower posts 38 (FIG. 1) are forced to move along the cam grooves to closed ends 52*a* thereof. When the lever structure reaches its final, fully mated position, cross portion 46 of the lever structure snaps behind latch shoulder 32 of flexible latch arm 28 of shroud 24. This locks the lever in its final position and, thereby, locks the two connectors in their fully mated condition. When it is desired to unmate the connectors, distal end 28*b* of latch arm 28 is depressed to allow the lever structure to be rotated opposite the direction of arrow "C" back to its inoperative position shown in FIG. 4. This forces cam follower posts 38 (FIG. 1) back along cam grooves 52 opposite the direction of arrow "D" (2) whereupon the connectors are back to the position shown in FIG. 4 with the cam follower posts aligned with open mouths 52*b* of the cam grooves. The connectors then can be unmated by snapping the cam follower posts over detent ribs 54 at the open mouths of the cam grooves.

Figure 6:
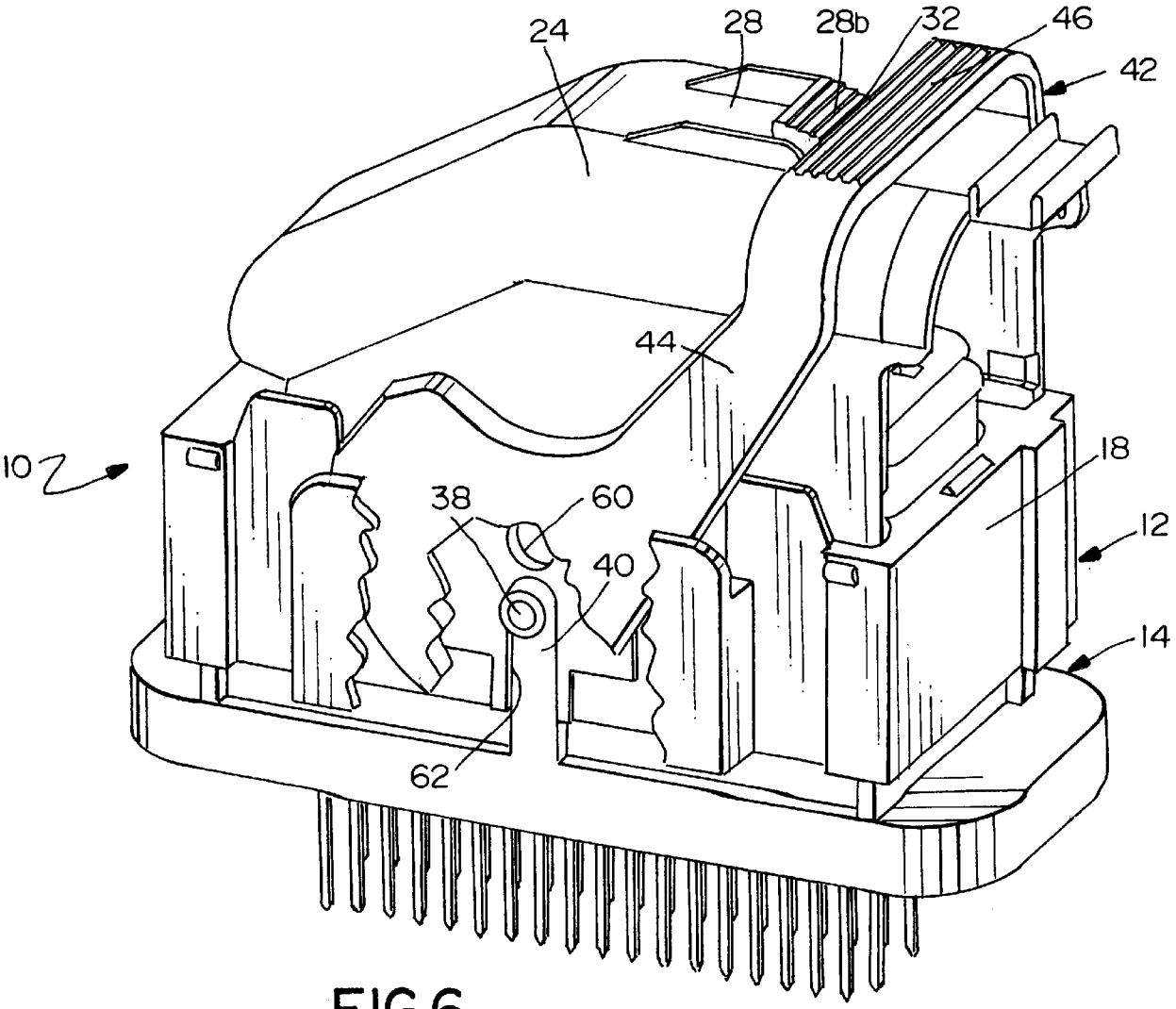
FIG. 6 is a view similar to that of FIG. 5, with one of the support walls of the first connector and a portion of the lever broken away to facilitate an illustration of the pivot engagement area between the connectors.

Finally, in the broken-away depiction of FIG. 6, it can be seen that each side of housing 18 of actuator connector 12 is provided with a groove 62 on each opposite side of the housing for receiving support rib 40 which extends from and is integral with cam follower post 38. With support ribs 40 being embraced within grooves 62, mating connector 14 cannot cock relative to mating connector 12 during mating and unmating of the connectors. Therefore, rib 40 performs a dual function of providing integral support for cam follower post 38 as well as providing an anti-cocking means between the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A lever type electrical connector assembly, comprising:

a first connector;

an actuating lever pivotally mounted on the first connector and including a cam groove formed therein;

a second connector having a cam follower projection to be engaged in the cam groove of the actuating lever whereby the connectors are mated and unmated in response to rotation of the actuating lever; and complementary interengaging pivot means between the actuating lever and the first connector and including separate, independently interengaging pivots between the lever and the first connector on both an inside and an outside of the actuating lever.

2. The lever type electrical connector assembly of claim 1 wherein said actuating lever includes a pair of pivot bosses on opposite sides thereof engageable in a pair of pivot journals on the first connector on opposite sides of the lever.

3. The lever type electrical connector assembly of claim 2 wherein said first connector includes a housing and a support wall spaced outwardly of the housing with the actuating lever disposed therebetween.

4. The lever type electrical connector assembly of claim 3 wherein said pivot journals comprise holes in the housing and in the support wall for receiving the pivot bosses projecting from opposite sides of the actuating lever.

5. The lever type electrical connector assembly of claim 2 wherein said first connector includes ramps for facilitating assembly of the pivot bosses of the actuating lever into the pivot journals of the first connector.

6. The lever type electrical connector assembly of claim 1 wherein said actuating lever comprises one actuating arm of a generally U-shaped lever structure having a pair of actuating arms pivotally mounted on opposite sides of the first connector.

7. The lever type electrical connector assembly of claim 1 wherein said second connector includes a housing with said cam follower projection being integral therewith and projecting therefrom, and the housing has an integral support rib leading from and integral with the cam follower projection.

8. The lever type electrical connector assembly of claim 7 wherein said housing, cam follower projection and support rib are unitarily molded of plastic material.

9. The lever type electrical connector assembly of claim 7 wherein said support rib extends in the mating direction of the connectors and said first connector includes a housing with a groove for receiving the support rib and preventing cocking of the connectors during mating.

10. The lever type electrical connector assembly of claim 1 wherein the cam groove in said actuating lever includes a mouth with a detent for capturing the cam follower projection in a pre-mated position of the second connector.

11. A lever type electrical connector assembly, comprising:

a first connector;

a generally U-shaped lever structure having a pair of actuating arms pivotally mounted on opposite sides of the first connector, each actuating arm including a cam groove formed therein;

a second connector having a cam follower projection on each opposite side thereof to be engaged in the cam grooves of the actuating arms whereby the connectors are mated and unmated in response to rotation of the lever structure; and complementary interengaging pivot means between each actuating arm and the first connector and including a pair of pivot bosses on opposite sides of each actuating arm engageable in a pair of pivot journals on the first connector on opposite sides of each actuating arm.

12. The lever type electrical connector assembly of claim 11 wherein said first connector includes a housing and a support wall spaced outwardly from each side of the housing, with the actuating arms disposed between the support walls and the housing.

13. The lever type electrical connector assembly of claim 12 wherein said pivot journals comprise holes in the housing and in the support walls for receiving the pivot bosses projecting from opposite sides of the actuating arms.

14. The lever type electrical connector assembly of claim 12 wherein said first connector includes ramps for facilitating assembly of the pivot bosses of the actuating arms into the pivot journals of the first connector.

15. The lever type electrical connector assembly of claim 11 wherein said second connector includes a housing with said cam follower projections being integral therewith and projecting therefrom, and the housing has an integral support rib leading from and integral with each cam follower projection.

16. The lever type electrical connector assembly of claim 15 wherein said housing, cam follower projections and support ribs are unitarily molded of plastic material.

17. The lever type electrical connector assembly of claim 15 wherein said support ribs extend in the mating direction of the connectors and said first connector includes a housing with grooves for receiving the support ribs and preventing cocking of the connectors during mating.

18. The lever type electrical connector assembly of claim 11 wherein the cam grooves in said actuating arms include mouths with detents for capturing the cam follower projections in a pre-mated position of the second connector.

* * * * *